US006925281B2

(12) United States Patent
Weber et al.

(10) Patent No.: US 6,925,281 B2
(45) Date of Patent: Aug. 2, 2005

(54) METHOD AND APPARATUS FOR FINISHING A RECEIVER SHEET OR SIMILAR SUBSTRATE

(75) Inventors: Scott D. Weber, Canandaigua, NY (US); Dale R. Mashtare, Bloomfield, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/318,767

(22) Filed: Dec. 12, 2002

(65) Prior Publication Data

US 2004/0114976 A1 Jun. 17, 2004

(51) Int. Cl.[7] ..... G03G 15/00
(52) U.S. Cl. ..... 399/341; 399/342
(58) Field of Search ..... 399/341, 342, 399/409, 401

(56) References Cited

U.S. PATENT DOCUMENTS

| | | | | |
|---|---|---|---|---|
| 5,045,888 A | | 9/1991 | Imaeda | |
| 5,053,818 A | * | 10/1991 | Smith | |
| 5,260,753 A | * | 11/1993 | Haneda et al. | 399/341 |
| 5,337,132 A | | 8/1994 | Cherian | |
| 5,339,146 A | | 8/1994 | Aslam et al. | |
| 5,506,671 A | | 4/1996 | Buts et al. | |
| 5,612,777 A | * | 3/1997 | Malhotra | |
| 5,737,677 A | | 4/1998 | Tombs et al. | 399/296 |
| 5,751,432 A | | 5/1998 | Gwaltney | |
| 5,804,341 A | | 9/1998 | Bohan et al. | 430/12 |
| 5,837,406 A | | 11/1998 | Tavernier et al. | 30/12 |
| 5,842,099 A | | 11/1998 | Aslam et al. | 399/324 |
| 5,847,738 A | | 12/1998 | Tutt et al. | 347/101 |
| 5,887,234 A | | 3/1999 | Aslam et al. | 399/322 |
| 5,926,679 A | | 7/1999 | May et al. | 399/296 |
| 6,150,062 A | * | 11/2000 | Sugizaki et al. | |
| 6,185,380 B1 | * | 2/2001 | Abe et al. | |
| 6,276,792 B1 | | 8/2001 | Gundlach et al. | 347/101 |
| 6,385,405 B1 | | 5/2002 | Kingsland | 399/2 |
| 6,539,191 B2 | * | 3/2003 | Itaya | |
| 6,681,095 B1 | * | 1/2004 | Tsuda | 399/341 |
| 2002/0167681 A1 | * | 11/2002 | Ide et al. | |
| 2003/0224178 A1 | * | 12/2003 | Chen et al. | |

FOREIGN PATENT DOCUMENTS

| | | | | |
|---|---|---|---|---|
| JP | 11242372 A | * | 9/1999 | G03G/15/01 |

OTHER PUBLICATIONS

Xerox Disclosure Journal, Title: "Color Prints With Uniform Gloss" by Jan Bares, vol. 16, No. 1, Jan./Feb. 1991.

* cited by examiner

*Primary Examiner*—Susan Lee
(74) *Attorney, Agent, or Firm*—Mark Z. Dudley

(57) ABSTRACT

Method and apparatus for finishing a receiver sheet or similar substrate by providing a protective coating on the receiver sheet for the benefit of, for example, protecting an image resident thereon. Such coating is created by applying and fusing a mixture containing a transparent, abrasion-resistant toner resin, and optionally components such as a light-fast material, to the receiver sheet.

22 Claims, 2 Drawing Sheets

METHOD AND APPARATUS FOR FINISHING A RECEIVER SHEET OR SIMILAR SUBSTRATE

BACKGROUND OF THE INVENTION

The present invention is generally directed to printing apparatus, receiver sheets, and finishing processes for such receiver sheets.

Among the technologies available for applying an image to a medium, such as paper, are xerography and direct marking. Common forms of direct marking include ink pen and ink jet marking technologies.

Xerographic printing typically uses a dry toner and produces on a print medium a clear, durable image. However, those familiar with xerography will also recognize that the hardware required for xerographically printing images, and particularly for printing images in multiple colors, may be somewhat complex.

In conventional xerography, electrostatic latent images are formed on a xerographic surface by first uniformly charging a charge retentive surface such as a photoreceptor. The charged area is selectively dissipated in accordance with a pattern of activating radiation corresponding to the original image. The selective dissipation of the charge leaves a latent charge pattern on the imaging surface corresponding to the areas not exposed by radiation. This charged pattern is made visible by developing it with toner. Such development includes passing the photoreceptor past one or more developer housings. Color xerographic printing commonly requires multiple developers, generally three color developers (yellow, cyan, and magenta) plus a black developer. The developed image is then fixed to the imaging surface, or is transferred to a receiving medium such as paper, to which it is fixed by suitable fusing techniques.

Direct marking technologies, and in particular ink jet printing, have emerged as printing alternatives that incorporate relatively simpler hardware requirements. In direct marking technologies, ink in the desired image is applied directly to the print medium. Various techniques of direct marking are well understood in the art. For example, the image may be applied by direct contact between a pen and the medium. Alternatively, ink jet recording techniques eject droplets of ink from a printhead onto the medium. Such ink jet techniques may include thermal ink jets, acoustic ink jet, piezo-electric ink jet printing, and others.

However, images produced with the inks used in ink jet marking technologies, and particularly in thermal ink jet marking technologies, do not always exhibit the same level of permanence as xerographically produced images. Typical dye-based and certain pigment based ink jet inks suffer from deficiencies, for example, in water fastness, smear resistance, light-fastness, gloss uniformity, and other appearance properties, after being printed on various substrates. Pigment based inks can provide an image, on a wide variety of substrates, having high optical density with high water fastness, smear resistance and light-fastness, and therefore pigment based are generally preferred to dye-based formulations for archival properties. Dye base ink materials, on the other hand, often more applicable in direct marking technologies and can also exhibit improved colorant properties. Nevertheless, the dye and or pigment based ink images are susceptible to print quality defects and to variability and idiosyncrasies associated with the receiver substrate media, such as, smearing. The images typically remain highly vulnerable to environmental image deterioration.

Xerographically produced images on receiver sheets and similar substrates can also benefit from improvements in their stability, permanence, and resistance to abrasion and adverse environmental effects.

In U.S. Pat. No. 5,847,738, issued Dec. 8, 1998, to Tutt, et al., there is disclosed a process of forming an overcoat on a printed image to provide improved stability comprising: a) applying an image layer on a substrate using a liquid ink to form an imaged element; b) either charging the imaged element to a given polarity or applying a voltage across the surface of the element which is attracted to a conductive surface behind the element; c) applying transparent, charged particles to the element which causes them to be electrostatically attracted to the surface of the image layer; and d) heat-fusing the particles to obtain a protective overcoat of the image layer.

In U.S. Pat. No. 5,612,777, issued Mar. 18, 1997, to Malhotra, there is disclosed an apparatus and method for creating color images which are coated with a composition including a lightfastness inducing material and a hydrophobic polymeric binder which protects the images from rough handling and degradation from exposure to UV radiation.

However, the prior art does not provide for a stand-alone finishing method or apparatus that employs contact development of an image bearing receiver sheet or similar substrate to provide a transparent overcoat on at least one surface of the receiver sheet. Thus, there remains a need for improved image quality and image stability of an image on an image-bearing receiver sheet that has been produced by a variety of printing devices and processes. These and other improvements are accomplished in embodiments of the present invention and as illustrated herein.

SUMMARY OF THE INVENTION

The present invention is directed to method and apparatus for finishing a receiver sheet or similar substrate by providing a transparent overcoat on the receiver sheet for the benefit of, for example, protecting pre-printed images. Such an overcoat is created by applying and fusing a mixture containing a transparent, abrasion-resistant toner resin and a light-fast material to the receiver sheet.

More specifically, the present invention is directed to an apparatus for receiving receiver sheets or similar substrates for finishing same with transparent toner and optionally other print quality performance enhancing additives that provide improved image properties. The apparatus and processes of the present invention offer a number of advantages, such as being operable as a stand-alone apparatus and method for coating toned or inked images, thus achieving improved image resolution and print stability properties, such as water and light-fastness properties, and reducing potential image defects and degradation.

The apparatus and processes of the present invention are useful in many applications in imaging and printing, including direct marking methods such as thermal ink jet (TIJ), bubble jet, ballistic marking, and acoustic ink printing.

Embodiments of the present invention can impart a light-fast and waterfast overcoat exhibiting uniform gloss to images present on a substrate. Such images, as will be disclosed herein, can be pre-printed on the receiver sheet by apparatus such as a color xerographic copier or printer.

In carrying out the invention, a contact development system employs a transparent toner containing a mixture of a transparent polymeric material and optionally a material which absorbs ultraviolet (UV) light to provide a transparent toner layer on a receiver sheet. The toner layer may be permanently fixed to a receiver sheet by fusing the toner layer to the receiver sheet via any combination of heat, pressure, and/or light energy. The transparent polymer material preferably exhibits hydrophobic properties. As a result, the coated receiver sheet surface is scuff and scratch resistant, as well as being resistant to damage from liquids and to color degradation from exposure to ultraviolet (UV) light.

DETAILED DESCRIPTION OF THE INVENTION

Figure 1:
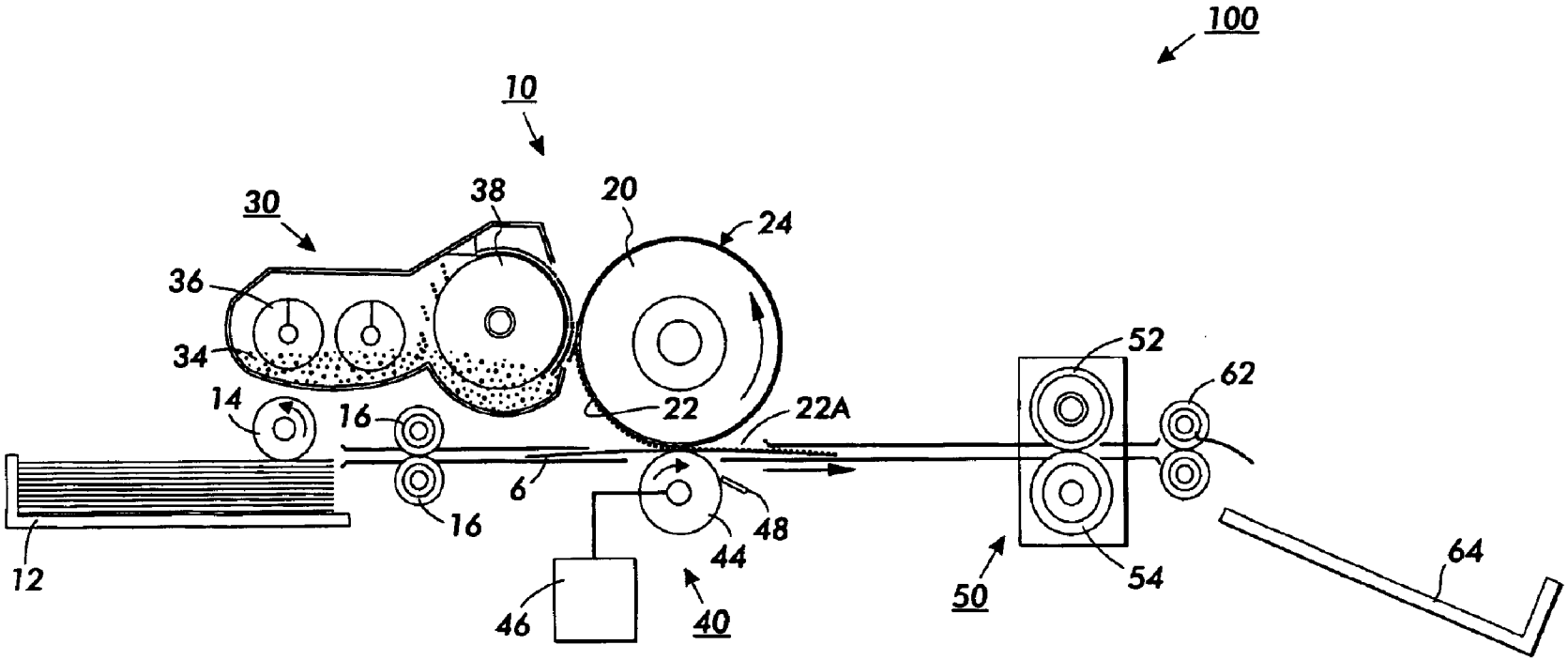
FIG. 1 is a schematic elevational view of an illustrative system for providing a transparent overcoat on a receiver sheet or similar substrate for the benefit of, for example, protecting images, constructed according to the present invention.

For a general understanding of the features of the present invention, reference is made to the drawings. In the drawings, like references have been used throughout to designate identical elements. It will become evident from the following discussion that the present invention is equally well suited for use in a wide variety of systems which employ a receiver sheet or similar substrate, and is not necessarily limited in its application to the particular printing systems described herein.

The present invention is directed to apparatus for coating images so as to impart to them improved image quality and durability. Such images, as will be disclosed herein, can be protected by receiving the uncoated image presented on a receiver substrate, depositing thereon an unfused layer of transparent toner particles, and thereafter fusing the transparent toner to the receiver substrate. The coated images obtain, for example, a high degree of smear and abrasion resistance.

The present invention also provides, in embodiments, a finishing process for depositing a transparent toner composition onto receiver sheet or similar substrate and fusing the resulting composition to form a coated receiver sheet. Preferably, the finishing process provides an integral coating over at least one entire surface of the receiver sheet.

Figure 2:
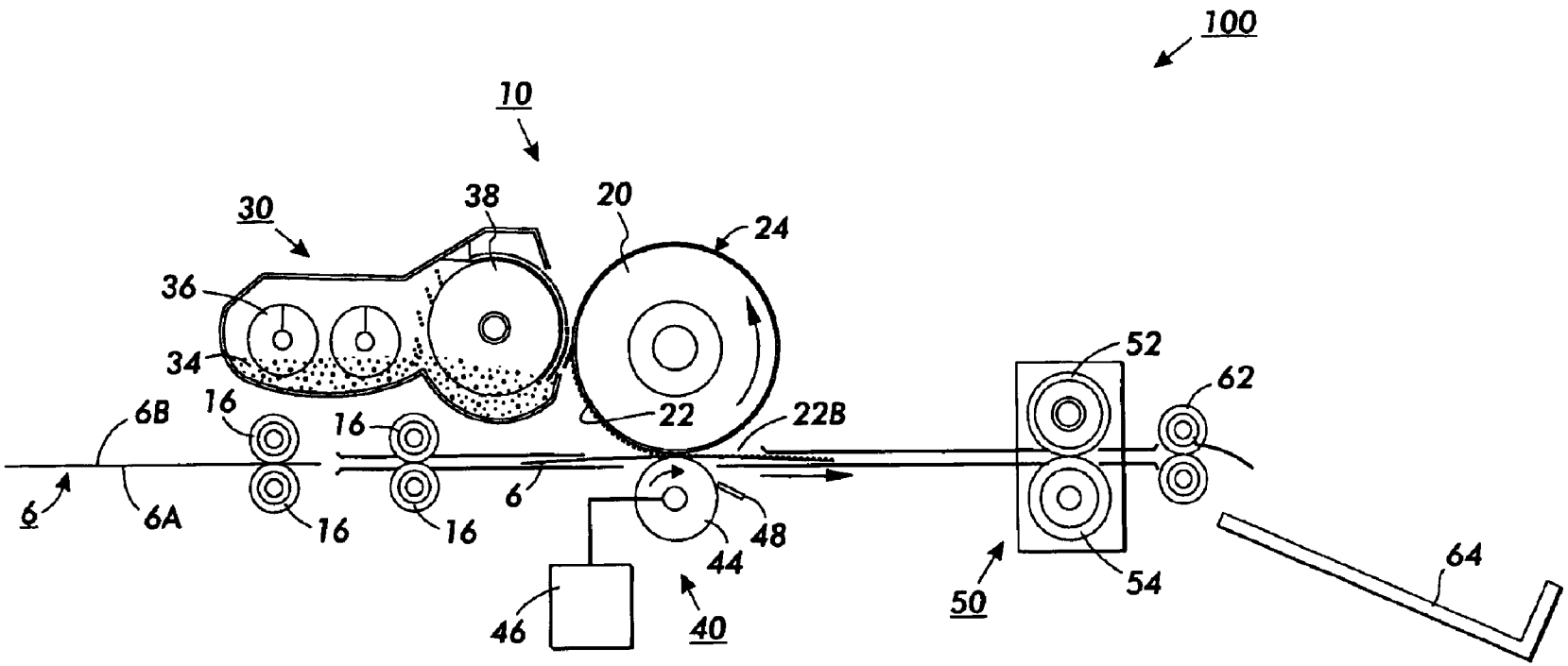
FIG. 2 is a schematic elevational view of an alternative embodiment of the system of FIG. 1.

With reference to the FIGS. 1 and 2 there is shown schematic elevational views of an illustrative receiver sheet finishing system 100 for providing a transparent overcoat on a receiver sheet or similar substrate. The system 100 employs a contact developer unit 10 operable for application of a toner layer 22 to a receiver sheet 6. The toner is preferably a transparent toner. The toner includes a binder in the form of a clear resin or polymer, and may include optional charge control additives, optional surface additives, optional surfactants, and a lightfastness inducing agent.

The illustrated contact developer unit 10 includes a toner layer applicator of a type generally referred to in the art as a magnetic brush development unit. Typically, a magnetic brush development unit employs a magnetizable developer material including magnetic carrier granules having toner particles adhering triboelectrically thereto. The developer material is continually brought through a directional flux field to form a brush of developer material. The developer material is constantly moving so as to continually provide the magnetic brush with fresh developer material. According to the present invention, contact development is achieved by application of developer material to a donor device to form a toner layer of predetermined dimensions and density, which is then transferred to the receiver sheet 6.

Accordingly, the contact developer unit 10 includes a seamless donor roll 20 having a surface 24 composed, for example, of alumina oxide, and a toner layer applicator provided in the form of a magnetic brush development unit 30. A mixing action mixes the toner with a carrier in a sump 34 by mechanical stirrers 36. The toner mixture may have a negative charge, for example, so that the toner is attracted to and adheres to the positively biased surface 24 of the donor roll 20. Although the illustrated embodiment employs a magnetic brush 38 to bring the toner mixture into proximity with the donor roll surface 24, those familiar with the art will appreciate that other types of toner development devices can be used to apply a layer of toner to the donor roll 20.

The magnetic brush development unit 30 preferably operates to apply a toner layer 22 having uniform thickness and selected density on the donor roll 20. The preferred toner layer 22 exhibits a predefined level of toner mass per unit area (TMA). The preferred toner layer 22 may be transferred in part or in whole to the receiver sheet 6. In a particularly preferred implementation, the toner layer 22 covers an area of the donor roll 20 that is slightly greater than the area of the surface of the receiver sheet 6 which is to be coated. This may be accomplished by use of a donor roll 20 and development unit 30 which are sufficiently wide to cover the entire width of the receiver sheet 6 (with such receiver sheet width being measured in the cross-process direction). Continual development of the donor roll 20 may serve to insure deposition of the toner layer along the full extent of the receiver sheet 6 in the process direction. In this manner, certain embodiments of the invention may employed for provision of a transparent coating to continuous web receiver materials.

The sump 34 contains a mixture of toner, preferably formed of transparent hydrophobic polymeric resin particles and a light-fast material (as well as other suitable additives), with carrier particles. The combination of transparent hydrophobic toner resin and light-fast material may be selected to provide a formulation suitable for imparting scuff or scratch resistant coating for the particular images on the receiver sheet 6, as well as for protecting such images from the deleterious effects of UV light. Additionally, use of the transparent toner also improves the gloss characteristics of such images.

The magnetic brush 30 may be moved into and out of an operative position with respect to the donor roll 20. In the operative position, the magnetic brush is closely adjacent the surface 24, while in the non-operative position, the magnetic brush is spaced therefrom. The developer unit 10 is illustrated in the FIGURE in the operative position. The use of the donor roll 20 reduces the likelihood of carrier particle carryout and developer contamination. Furthermore, TMA levels can be very closely controlled due to the decreased sensitivity of the developer unit to the variability introduced by substrate differences that would otherwise affect the development process.

It will be appreciated by those skilled in the art that scavengeless or non-interactive development systems known in the art could be used in lieu of the illustrated magnetic brush 30.

A transfer element 40 employed to transfer the toner layer 22 from the surface 24 of the donor roll 20 onto at least one surface of the receiver sheet 6. In the illustrated embodiment, receiver sheet 6 is provided in the form of a sheet of paper. The transfer element 40 includes a biased transfer roller 44 for pressing the upper, surface of the receiver sheets 6 against the surface 24. Preferably, the transfer roller 44 is formed of an electrically-conductive elastomer. An electrical bias source 46 electrically biases the transfer roller 44, forming an electrostatic field across the toner layer and between the surface 24 and the transfer roller 44 to encourage transfer of the toner layer 22 from the surface 24 onto the upper surface of the receiver sheet 6. The electrical voltage applied to the transfer roller 44 with respect to the donor roll 20 is of sufficient magnitude so that the electrostatic attraction of the toner layer 22 toward the receiver sheet 6 is stronger than the electrostatic attraction between the toner layer 22 and the surface 24. Voltage polarities may be selected based upon the charge species of transparent toner used in a specific embodiment.

In other applications, the receiver sheet 6 may alternatively be passed between a transfer corotron (not shown) and the donor roll surface 24 to apply a charge to the underside of the receiver sheet 6 to promote the transfer of the toner layer 22 onto the receiver sheet 6. Those familiar with the xerographic printing arts will be familiar with such transfer corotrons.

In addition, a pre-transfer station (not shown) may be positioned adjacent the donor roll 20 and near the transfer element 40 to modify the charge of the toner layer 22 to enhance the transfer of the toner layer 22 from the surface 24. Such pre-transfer stations are known to those familiar with the xerographic printing arts.

As noted above, the medium chosen for the receiver sheets 6 may be paper, including plain paper. In FIG. 1, the paper is stored in paper tray 12. A feed roller 14 draws a sheet of paper from the tray. Transport rollers 16 move the sheet of paper along a paper path to the transfer element 40, and align the paper between the surface 24 and the transfer roller 44. Preferably, the receiver sheet 6 is registered with the donor roll 20 such that after the toner layer 22 is transferred to the receiver sheet 6, all of the surface area of the upper surface of the receiver sheet 6 is coated. Other media may also be used for the receiver sheet 6, including clear transparencies, vinyl sheets, transfer media, etc. In addition, the media may be in the form of long strips cut from a roll, rather than individual sheets. Additionally, an embodiment of the present invention may be employed to coat a receiver material in the form of a continuous web.

A stripping mechanism (not shown) may be positioned adjacent the transfer element 40 to assist in lifting the receiver sheet 6 from the surface 24 of the donor roll 20. The stripping mechanism may be advantageous in circumstances in which the receiver sheet 6, after passing the transfer element 40, tends to stick to the surface 24. Mechanical stripper fingers or an air knife are examples of the stripping mechanisms which may be applied. Additionally, the construction of the donor and/or transfer roll diameters may be optimized such that self-stripping is achieved when sufficient beam strength in the receiver sheet material occurs as the receiver sheet 6 exits the transfer roller nip region.

The described deposition of the toner layer 22 to the receiver sheet 6 is preferably accomplished before the receiver sheet 6 undergoes fixing. As illustrated in FIG. 2 the receiver sheet 6 may optionally be re-circulated for application of another portion of the toner layer to the opposite surface of the receiver sheet material before or after undergoing fixing. Fixing may be accomplished, preferably, for a given one of first and second surfaces 6A and 6B after the step of toner layer deposition, and prior to subsequent opposite surface coating, or alternatively both first and second surfaces 6A, 6B may receive respective toner layers prior to fixing. A tandem system configuration may be envisioned in which both surfaces are coated in a continual processing mode.

In the illustrated embodiment, the fuser 50 fixes the deposited toner layer onto the upper surface of the receiver sheet 6. The fuser 50 may be of the type conventionally used with xerographic printers. For example, the fuser 50 may include a fuser roller 52 and a pressure roller 54. The fuser roller 52 may be heated to melt the toner while the pressure roller 54 presses the upper surface of the receiver sheet 6 against the fuser roller 52. The fuser roller 52 may be replaced with a pressure roll for effecting pressure fixing, or with another fusing device, such as a non-contacting radiant fusing device. Those familiar with the xerographic printing arts will recognize that radiant fusing may also be employed. Radiant fusing systems use intense light, such as a quartz rod to melt the toner and fuse it with the fibers of the paper. Those skilled in the art will also recognize that other fusing processes used in the xerographic printing art may also be used for the requisite fixing step.

As the preferred embodiment of the present invention applies a toner layer 22 that is more than sufficient to coat the full surface area of the upper surface of the receiver sheet 6, operation of a cleaning station 48 such as a cleaning blade is preferred to remove excess toner from the transfer roller 44 in preparation for the next finishing cycle. The cleaning station 48 may be operated to not only remove residual toner from the transfer roller 44 but also to electrically neutralize its surface, if necessary. Such cleaning stations are well known in the xerographic printing arts.

In preferred embodiment of the present invention, the toner layer 22 is uniformly deposited over the total surface area of the upper surface of the receiver sheet 6. That is, the transparent toner can be deposited onto the receiver sheet 6 to afford substantially complete and uniform coverage of that side of the receiver sheet 6. Hence, the layer 22 of transparent toner particles can be dimensionally larger than the receiver sheet 6 so as to completely cover the upper surface of the receiver sheet 6. Such a technique, for example, can also compensate for respective sheet registration errors, thereby ensuring complete coverage of a selected one or both of the first and second surfaces 6A, 6B of the receiver sheet 6 with a protective transparent layer.

One skilled in the art will appreciate that embodiments of the invention may include additional conventional apparatus (not shown) for moving receiver sheet 6 in a recirculating path for performing additional finishing cycles when additional finishing is desired, e.g. for application of a second overcoat over a pre-existing overcoat already provided as described above with respect to the upper surface of the receiver sheet 6. Coating of the second surface 6B can follow the coating of the first surface 6A so as to result in establishing a protective layer on both surfaces. Application of toner layers to both the surfaces of the receiver sheet can be done and both are then fused to the receiver sheet 6. Coating of both sides of a receiver sheet can provide enhanced protection by preventing moisture absorption by certain substrate materials that are susceptible to moisture absorption, and can reduce or minimize, for example, problems such as curling, etc.

Alternatively, in still other embodiments, the protective coating can be formed on a given side of the receiver sheet prior to the receiver sheet being processed by any of known reprographics apparatus for imparting an image to its opposite (uncoated) surface. After the imaging of the uncoated side is performed by such apparatus (not shown), the receiver sheet is then returned to the illustrated embodiment for coating of the image present on the uncoated side.

In the illustrated embodiments, the receiver sheet 6, now coated with the fused toner, is then transferred by output transport rollers 62 to an output element, such as an output tray 64.

Hence, the protective layer fused toner seals any pre-existing image present on a respective surface of the receiver sheet 6, thus improving the colorfastness of the image and also reducing the tendency of such image to degrade when exposed to abrasion, contaminants, water, UV radiation, or adverse conditions such as high humidity.

An image, as described herein with respect to embodiments of the present invention, can be printed on the receiver sheet 6 by any suitable conventional process and variants thereof. The present invention is especially useful in a sheet finishing process that includes the coating of an image made with toner or ink compositions known in the art, and may find advantageous use has a standalone or dedicated apparatus operable in conjunction with, for example, electrophotographic and ink jet printing machines. Accordingly, advantageous use is expected in color printing systems that employ various processes including: inkjet, offset lithography, letterpress, gravure, xerography, photography, and many other image reproduction processes. Examples of apparatus with which the disclosed coating apparatus may be employed for receiver sheet finishing include: hardcopy reprographic devices such as inkjet, dye sublimation, and xerographic printers, lithographic printing systems, silk-screening systems, and photographic printing apparatus; systems for imagewise deposition of discrete quantities of a marking material on a substrate surface, such as paint, chemical, and film deposition systems; and systems for integration of colorant materials in an exposed surface of a fibrous substrate, such as textile printing systems. Application of the disclosed process is compatible with an image process using aqueous-based inks, such as flexographic printing, pen plotters, continuous stream ink jet printing, drop-on-demand ink jet printing including both piezoelectric and thermal ink jet processes, and the like printing devices.

In embodiments, typical toner deposition levels, in toner mass per unit area (TMA), can be from about 0.1 $mg/cm^2$ to about 10 $mg/cm^2$ and preferably from about 0.4 $mg/cm^2$ to about 2.0 $mg/cm^2$, and more preferably at least 1.0 $mg/cm^2$. Toner diameter size may be in the range of about 1 micron to 100 microns. Application of large particle dimensions are permitted as long as the toner material will not adversely effect image resolution while still functioning to protect the image information.

Whereas the preferred toner is described herein as transparent, toner materials that incorporate additives that function to impart a slight to moderate amount of coloration or color cast to the protective coating may be advantageously employed in certain embodiments. The protective coating may be employed to impart, for example, decorative or artistic effects, or for imparting a particular spectrally-based characteristic or designation to the receiver sheet, such as may be useful for differentiating between certain coated receiver sheets according to their color. An alternative example can be a toner material for providing a protective coating that is formulated to fluoresce when exposed to an appropriate light source.

The processes of the present invention can overcoat, in a single pass, a receiver sheet with or without a pre-formed inked or toned image. Accordingly, certain embodiments of the present invention are useful for post-processing, i.e. finishing, of unimaged receiver sheets. With respect to imaged receiver sheets, the image may contain a colorant such as known pigments, dyes, and mixtures thereof. The receiver sheet can be selected, for example, as paper, transparency materials, plastics, polymeric films, treated cellulosics, wood, and mixtures thereof. Optional additives coated may be thereon which can include, for example, light-fastness improving compounds, stability enhancing compounds (such as ultraviolet light absorbing compounds and antioxidants), anti-curl compounds, such as trimethylolpropane for cool curl control, hydrophilic compounds, polyethylene oxide and propylene oxide polymers, surfactants such as low HLB (0–6) compounds, including nonionic, anionic, cationic, and zwitterionic compounds, ink gellation agents such as gum additives including xanthan gum, agar, guar, lecithin, and the like materials, and mixtures thereof.

The preferred transparent toner can be comprised substantially of transparent resin particles. The transparent resin particles can be formulated using conventional and known materials, and as described herein. The transparent toner can be optimized for its properties for advantageous fusing to the receiver sheet according to known and conventional fusing methodologies including, for example, heat, light, pressure, and combinations thereof.

The transparent toner can include, for example, (1) a binder in the form of a clear resin toner such as: (A) polyesters; (B) polyvinyl acetals; (C) vinyl alcohol-vinyl acetal copolymers; (D) polycarbonates; (E) styrene—alkyl acrylate copolymers and styrene—aryl alkyl acrylate copolymers; (F) styrene-diene copolymers; (G) styrene—maleic anhydride copolymers; (H) styrene—allyl alcohol copolymers; and mixtures thereof; (2) optional charge control additives such as alkyl pyridinium halides, cetyl pyridinium chloride, cetyl pyridinium tetrafluoroborates, quaternary ammonium sulfate and sulfonate compounds, such as distearyl dimethyl ammonium methyl sulfate; (3) optional surface additives such as straight silica, colloidal silica, UNILIN™, polyethylene waxes, polypropylene waxes, aluminum oxide, stearic acid, polyvinylidene fluoride, and the like; (4) optional surfactants such as nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, and the like; and (5) a lightfastness inducing agent such as 1,2-hydroxy-4-(octyloxy)benzophenone, 2-(4-benzoyl-3-hydroxyphenoxy) ethylacrylate and the like. Preferably, the binder comprises a polycarbonate in order to provide the toner image with a finish that exhibits excellent abrasion resistance.

The lightfastness inducing material or agent contained in the toner mixture comprises a UV absorbing compound selected from the group consisting of 2-(4-benzoyl-3-hydroxyphenoxy)ethylacrylate (Cyasorb UV-416, #41,321-6, available from Aldrich chemical company), 1,2-hydroxy-4-(octyloxy)benzophenone (Cyasorb UV-531, 41,315-1, available from Aldrich chemical company), poly[2-(4-benzoyl-3-hydroxyphenoxy)ethylacrylate](Cyasorb UV-2126, #41,323-2, available from Aldrich chemical company), hexadecyl 3,5-di-tert-butyl-4-hydroxybenzoate (Cyasorb UV-2908, #41,320-8, available from Aldrich chemical company), poly[N,N-bis(2,2,6,6-tetramethyl-4-piperidinyl)-1,6-hexanediamine-co-2,4-dichloro-6-morpholino-1,3,5-triazine) (Cyasorb UV-346, #41,324-0, available from Aldrich chemical company), 2-dodecyl-N-(2,2,6,6-tetramethyl-4-piperidinyl)succinimide (Cyasorb UV-3581, #41,317-8, available from Aldrich chemical company), 2-dodecyl-N-(1,2,2,6,6-pentamethyl-4-piperidinyl)succinimide(Cyasorb UV-3604, #41,318-6, available from Aldrich chemical company), N-(1-acetyl-2,2,6,6-tetramethyl-4-piperidinyl)-2-dodecylsuccinimide (Cyasorb UV-3668, #41,319-4, available from Aldrich chemical company), 1-[N-[poly(3-allyloxy-2-hydroxypropyl)-2-aminoethyl]-2-imidazolidinone (#41,026-8, available from Aldrich chemical company),poly(2-ethyl-2-oxazoline)(#37,284-6, #37,285-4, #37,397-4, available from Aldrich chemical company).

Any suitable substrate can be employed as the receiver sheet 6. A receiver sheet or similar substrate can be, for example, composed of known print receiver materials, such as paper, transparency materials, plastics, polymeric films, treated cellulosics, wood, and the like materials, cardboard, and other pulp-based and printed packaging products, laminated or fibrous compositions; and textiles. Illustrative examples of commercially available internally and externally surface sized papers include Diazo papers, offset papers, such as Great Lakes offset, recycled papers, such as Conservatree, office papers, such as Automimeo, Eddy liquid toner paper and copy papers available from companies such as Nekoosa, Champion, Wiggins Teape, Kymmene, Modo, Domtar, Veitsiluoto, Sanyo, and coated base papers available from companies such as Scholler Technical Papers, Inc. and the like. Examples of substantially transparent substrate materials include polyesters, including MYLAR™, available from E. I. Du Pont de Nemours & Company, MELINEX™, available from Imperial Chemicals, Inc., CELANAR™, available from Celanese Corporation, polyethylene naphthalates, such as Kaladex PEN Films, available from Imperial Chemicals, Inc., polycarbonates such as LEXAN™, available from General Electric Company, polysulfones, such as those available from Union Carbide Corporation, polyether sulfones, such as those prepared from 4,4'-diphenyl ether, such as UDEL™, available from Union Carbide Corporation, those prepared from disulfonyl chloride, such as Victrex™, available from ICI Americas Incorporated, those prepared from biphenylene, such as ASTREL™, available from 3M Company, poly(arylene sulfones), such as those prepared from crosslinked poly(arylene ether ketone sulfones), cellulose triacetate, polyvinylchloride cellophane, polyvinyl fluoride, polyimides, and the like, with polyester such as MYLAR™ being preferred in view of its availability and relatively low cost. The substrate can also be opaque, including opaque plastics, such as TESLIN™, available from PPG Industries, and filled polymers, such as MELINEX™, available from ICI. Filled plastics can also be employed as the substrate, particularly when it is desired to make a "never-tear paper" recording sheet.

What is claimed is:

1. A method for finishing a receiver sheet or similar substrate, the receiver sheet having first and second surfaces, comprising the steps of:

providing a toner composition;

applying a quantity of the toner composition to a donor device so as to create a uniform integral layer of the toner composition;

transporting the receiver sheet to a transfer station for contact between the donor device and the receiver sheet so as to transfer a portion of the layer of toner composition onto the first and second surfaces of the receiver sheet; and fusing the resulting transferred portion to the receiver sheet so as to fix a protective layer of the fused toner composition on the receiver sheet;

wherein first and second segments of the toner layer portion are respectively transferred to the first and second surfaces of the receiver sheet and the resulting first and second segments are fused to the receiver sheet.

2. The method of claim 1, wherein the toner composition is comprised substantially of transparent resin particles.

3. The method of claim 1 wherein a level of toner layer application, in toner mass per unit area (TMA), is provided from about 0.1 mg/cm$^2$ to about 10 mg/cm$^2$ and the toner composition includes particles of a diameter provided in the range of about 1 micron to 100 microns.

4. The method of claim 1, wherein the toner composition includes an additive in the form of at least one of the following: lightfastness improving compounds, color cast inducing compounds, stability enhancing compounds, anti-curl compounds, hydrophilic compounds, ink gellation agents, and mixtures thereof.

5. The method of claim 1, wherein the portion of the toner layer is deposited over the total surface area of at least one of the first and second surfaces of the receiver sheet.

6. The method of claim 5, wherein the surface area of the layer of toner composition applied to the donor device exceeds the surface area of the portion of toner layer deposited therefrom onto at least one of the first and second surfaces of the receiver sheet.

7. The method of claim 1, wherein the first and second segments of the toner layer portion are respectively transferred to the first and second surfaces of the receiver sheet prior to the first and second segments being fused to the receiver sheet.

8. The method of claim 7, wherein said first portion segment is transferred and fused to the receiver sheet prior to said second portion segment being transferred and fused to the receiver sheet.

9. The method of claim 1, wherein the receiver sheet is of a format selected from the group consisting of cut sheet and continuous web, and wherein the receiver sheet is of a material selected from the group consisting of paper, transparency materials, plastics, polymeric films, treated cellulosics, wood, and mixtures thereof.

10. The method of claim 1, wherein the fusing is accomplished with at least one of heat, light, pressure, or combinations thereof.

11. A system for finishing a receiver sheet or similar substrate, the receiver sheet having first and second surfaces, comprising:

a toner layer applicator for providing a quantity of toner composition;

a donor device for receiving the quantity of toner composition thereon as a uniform integral toner layer;

a transfer station for receiving the receiver sheet and for engaging contact between the donor device and the receiver sheet so as to transfer a portion of the toner layer onto the first and second surfaces of the receiver sheet; and a fuser for fusing the resulting transferred portion to the receiver sheet;

wherein the system being operable for transferring first and second segments of the toner layer portion respectively to the first and second surfaces of the receiver sheet and for fusing the resulting first and second segments to the receiver sheet.

12. The system of claim 11, wherein the toner applicator and donor device further comprise a magnetic brush and donor roller, respectively, and wherein the magnetic brush is adapted to deposit a layer of toner composition onto a surface of the donor roller.

13. The system of claim 11, wherein the transfer station further comprises a charge transfer element for charging the receiver sheet, and wherein the toner layer portion is of opposite polarity to the polarity of the charge being applied to the receiver sheet.

14. The system of claim 13, further comprising a conveying path for conveying the receiver sheet to the transfer station for carrying out the charging and the toner layer portion transfer, and thereafter to the fuser.

15. The system of claim 11, wherein the portion of the toner layer is deposited over the entire surface area of at least one of the first and second surfaces of the receiver sheet.

16. The system of claim 15, wherein the surface area of the toner layer formed on the donor device exceeds the surface area of the portion of toner layer deposited therefrom onto at least one of the first and second surfaces of the receiver sheet.

17. The system of claim 11, wherein first and second segments of the toner layer portion are respectively transferred to the first and second surfaces of the receiver sheet prior to the transferred segments being fused to the receiver sheet.

18. The system of claim 17, wherein said first segment is transferred and fused to the receiver sheet prior to said second segment being transferred and fused to the receiver sheet.

19. The system of claim 11, wherein the toner composition is comprised substantially of transparent resin particles.

20. The system of claim 11, wherein a level of toner layer application, in toner mass per unit area (TMA), is provided from about 0.1 $mg/cm^2$ to about 10 $mg/cm^2$ and the toner composition includes particles of a diameter provided in the range of about 1 micron to 100 microns.

21. The system of claim 11, wherein the toner composition includes an additives in the form of at least one of the following: lightfastness improving compounds, color cast inducing compounds, stability enhancing compounds, anti-curl compounds, hydrophilic compounds, ink gellation agents, and mixtures thereof.

22. The system of claim 11, wherein the receiver sheet is of a format selected from the group consisting of cut sheet and continuous web, and wherein the receiver sheet is of a material from the group consisting of paper, transparency materials, plastics, polymeric films, treated cellulosics, wood, and mixtures thereof.

* * * * *